United States Patent [19]

Maier

[11] 4,200,216

[45] Apr. 29, 1980

[54] DEVICE FOR TRANSPORTING FASTENING ELEMENTS THROUGH A SETTING DEVICE

[75] Inventor: Elmar Maier, Tisis, Austria

[73] Assignee: Hilti Aktiengesellschaft, Schaan, Liechtenstein

[21] Appl. No.: 936,594

[22] Filed: Aug. 24, 1978

[30] Foreign Application Priority Data

Aug. 29, 1977 [DE] Fed. Rep. of Germany ..... 2738849

[51] Int. Cl.[2] ..... B25C 1/00

[52] U.S. Cl. ..... 227/136; 227/126

[58] Field of Search ..... 227/125–126, 227/135–137

[56] References Cited

U.S. PATENT DOCUMENTS

| | | | |
|---|---|---|---|
| 3,491,932 | 1/1970 | Novak | 227/136 |
| 3,554,425 | 1/1971 | Oesterle | 227/136 |
| 3,774,832 | 11/1973 | Maier | 227/136 |
| 3,891,133 | 6/1975 | Maier et al. | 227/136 |

*Primary Examiner*—John McQuade

*Attorney, Agent, or Firm*—Toren, McGeady and Stanger

[57] ABSTRACT

In the housing of a setting device for driving fastening elements, a belt-like magazine holding fastening elements in spaced relation is moved through a guide channel transversely of the path of a driving piston. A transport device positioned in the housing moves the magazine through the guide channel in a step-wise manner. A stop lever is pivotally mounted in the housing and is spring-biased at one end into the guide channel. When the magazine is located within the guide channel in the path of the stop lever, the transport device can be operated to move the magazine. When the magazine is moved out of the path of the stop lever, however, the stop lever extends further through the guide channel and its other end engages a pawl on the transport device blocking its operation so that the magazine cannot be moved through the guide channel.

7 Claims, 3 Drawing Figures

DEVICE FOR TRANSPORTING FASTENING ELEMENTS THROUGH A SETTING DEVICE

SUMMARY OF THE INVENTION

The present invention is directed to a setting device for driving in fastening elements and, more particularly, it concerns the arrangement of a transport device for feeding a belt-shaped magazine in a step-wise manner through a guide channel extending through the housing of the setting device.

Fastening element setting devices are used at the present time in many areas of the fastening art. Depending on its type and the location of its use, a setting device can be driven pneumatically, hydraulically, electromagnetically, or by means of an explosive powder charge. To shorten the loading period and, accordingly, the time for carrying out a working cycle between two driving operations, it has been known to place the fastening elements as well as explosive powder propellant charges in belt-shaped magazines. Usually, a transport device is provided within the setting device for engagement with projections or recesses on the magazine for moving it in a step-wise manner.

Magazines holding fastening elements are also manufactured in extended lengths and are separated, if necessary, into desired lengths for use. There is no guarantee that the separation into individual lengths of the magazine takes place in the region of a transport element, accordingly, there is the danger that the transport device acting on the end of the magazine length only transports it a fraction of the normal step-wise length. Such improper transport of the magazine may cause interruptions in the operation of the setting device and it may also damage the device. If the transport device is moved less than the spacing between fastening elements, the driving member may strike the magazine between two fastening elements.

Attempts at correcting this problem have usually led to extended stoppages of the operation of the setting device.

During use of the setting device, it is desirable to sever the portion of the magazine no longer required after a driving operation has been effected. As a result, as the end of a length of a magazine is reached, the length of the guided portion is continuously decreased. When the guided portion becomes so short that it is smaller than the width of the magazine, the magazine may become jammed in the guide channel. If such a jam should occur, then long stoppages in operation of the device will result having a negative effect on the efficient use of the device.

Therefore, the primary object of the present invention is to provide a setting device for driving fastening elements in which the transport device cannot be operated as the trailing end of the magazine approaches the path of the driving member.

In accordance with the present invention, a stop member is provided which extends into the guide channel and engages the magazine, however, when the magazine is no longer in the path of the stop member, the stop member is further displaced through the guide channel and blocks the operation of the transport device.

When the trailing end of the magazine passes the stop member before it reaches the path of the driving member, the movement of the stop member prevents any displacement of the magazine through the guide channel. When the stop member is again engaged by another magazine length, the transport device is released for further operation. The stop member can be constructed as a slide movable in a linear direction or as a pivotal lever. The transport device can be manually operated or it can be driven pneumatically or in some similar manner. Where the setting device is pneumatically driven, it is advantageous to drive the transport device in the same manner.

To save material, as a rule, belt-shaped magazines with relatively thin cross-sections are used. To provide an effective shifting distance of the stop member to provide an effective locking action on the transport device, it is advantageous if the stop member is formed as a pivotally mounted two-armed lever. When such a lever is used, the first arm extends into the guide channel and the second arm effects the locking action on the transport device. With the appropriate dimensioning of the two lever arms, the distance through which the first arm is shifted when the end of the magazine moves out of its path, can effect a displacement of the second arm which is a multiple of the magazine thickness because of the stepup action.

To ensure effective operation of the setting device in any position, it is advantageous if the stop member is spring-biased into the guide channel. As a result, the stop member is maintained in continuous contact with the magazine as it moves through the guide channel. With such an arrangement, the stop member affords another function, that is, it holds or clamps the magazine within the setting device.

To prevent any accidental movement of the magazine through the guide channel, it is helpful if the stop member includes a detent which extends into the guide channel and engages recesses in the magazine. In such an arrangement, the detent should always engage a recess in the magazine when one of the fastening elements positioned in the magazine is located in front of the driving member. When such an arrangement is used, ball notches or the like for locking the magazine while a fastening element is being driven, are unnecessary.

Further, to ensure that the magazine can be inserted into the guide channel at its inlet end, it is advantageous if the detent has a special saw-toothed shape. Unlike a conventional ball notch, a special saw-tooth detent can be provided with an edge which affords a stop against any return movement of the magazine. To prevent any premature wear of the detent as well as any damage to the magazine, the tip of the saw-tooth detent can be cut off providing it with a somewhat truncated shape.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
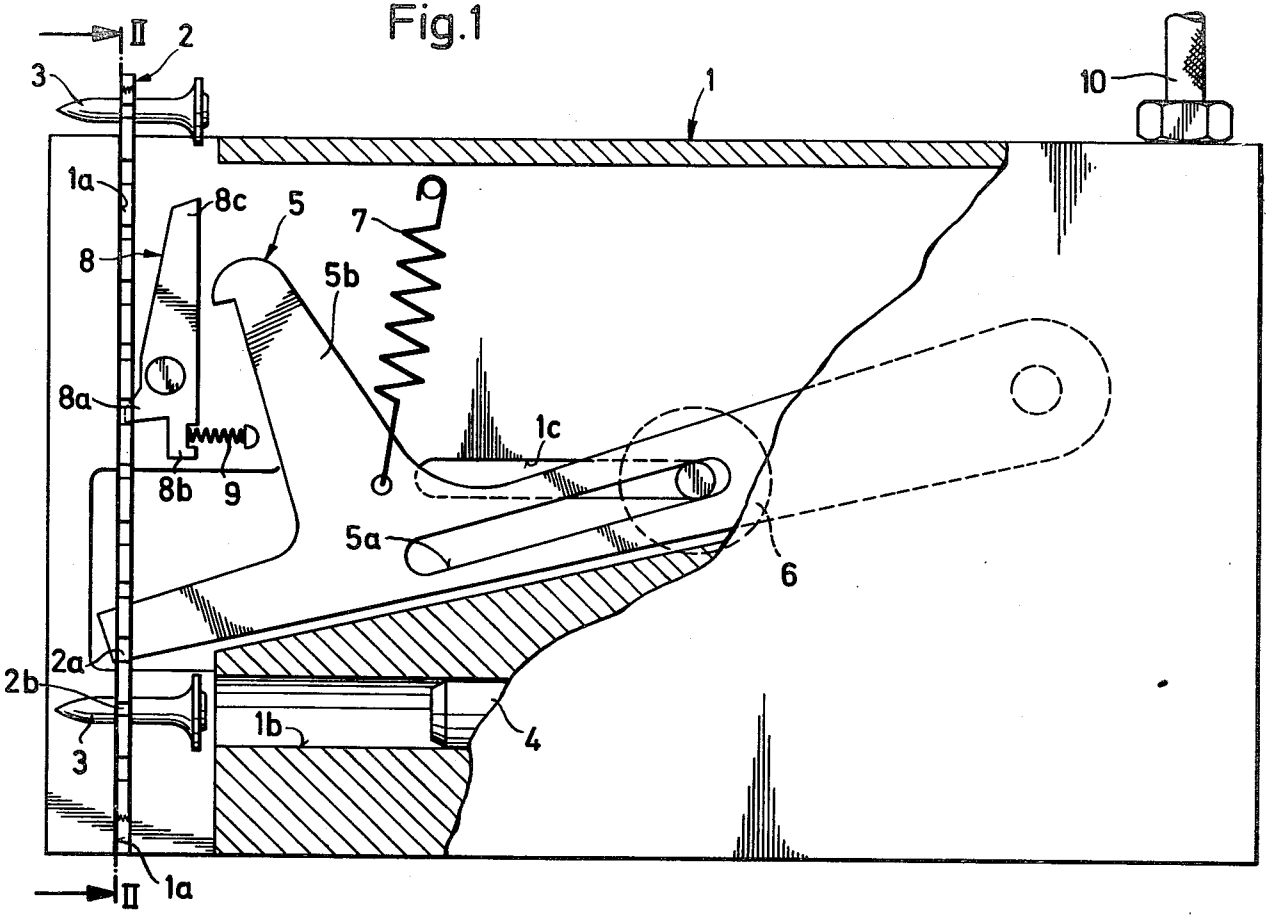
FIG. 1 is a side view, partially broken away, of a setting device embodying the present invention with a magazine inserted into the device and a transport lever engaging the magazine.

In FIG. 1 a fastening element setting device is shown including a housing 1. The front end, or left hand end as viewed in FIG. 1, of the housing has a guide channel 1*a* extending perpendicularly of the direction in which fastening elements 3 are driven from the setting device. Positioned within the guide channel 1*a* is a belt-shaped magazine 2 holding nail-like fastening elements 3 in a spaced arrangement. For sake of clarity, only the first fastening element 3 located in front of a piston guide 1*b* as well as the last fastening element in the magazine 2 are shown. The forward end of a drive piston 4 can be seen in the piston guide 1*b*. A transport lever 5 is pivotally mounted at its rearward end within the housing 1, that is, its end adjacent the right hand end of the housing. Transport lever 5 engages recesses 2*a* for transporting the magazine 2. Intermediate its opposite ends, the lever has an oblong slot 5*a*. A similarly shaped slot 1*c* is formed in the housing 1. The transport lever 5 has a handle 6 positioned on the exterior of the housing 1, note FIG. 2. The transport handle 6 has a shaft extending through the slot 1*c* in the housing and the similarly shaped slot 5*a* in the transport lever 5. When the transport handle 6 is moved in the rearward direction of the setting device, through the slots 1*c*, 5*a*, the transport lever is displaced into the position shown in FIG. 1. A tension spring 7 connected at one end to the housing and at its other end to the transport lever, biases the lever into the starting position as shown in FIG. 3. A two-armed lever 8 is pivotally mounted within the housing adjacent the guide channel 1*a*. A laterally extending detent 8*a* is formed on the first arm 8*b* which extends downwardly from the pivotal attachment of the two-armed lever 8 to the housing. The detent 8*a* also engages in the recesses 2*a* of the magazine 2. Second arm 8*c* of the two-armed lever extends upwardly from the pivotal attachment toward the upper or inlet end of the guide channel 1*a*. The detent 8*a* has a generally truncated saw-toothed shape. The tip of the detent is cut off and its side or edge facing toward the inlet end of the guide channel extends obliquely to the channel. This oblique shape of the upwardly facing edge of the detent 8*a* permits the magazine 2 to be inserted downwardly through the guide channel from its upper inlet end toward its lower outlet end. The downwardly facing edge of the detent 8*a* extends generally perpendicularly of the line of the guide channel and prevents the magazine from making any return movement, that is, upwardly toward its inlet end, once it has been inserted into engagement with the detent. A compression spring 9 contacts the first arm 8*b* of the two-armed lever 8 and biases the detent 8*a* into the guide channel 1*a*. A connection 10 for compressed air is located at the top of the housing 1 toward its rearward end.

Figure 2:
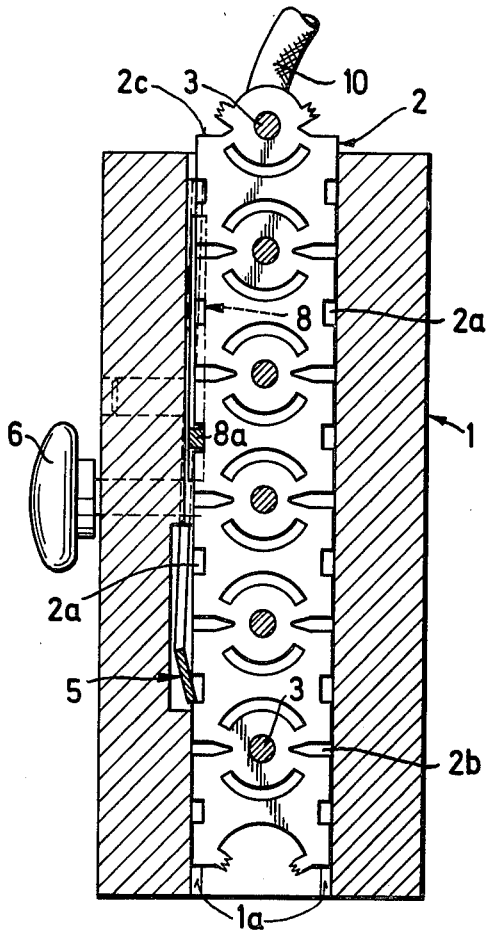
FIG. 2 is a sectional view of the setting device illustrated in FIG. 1 and taken along the line II—II.
Figure 3:
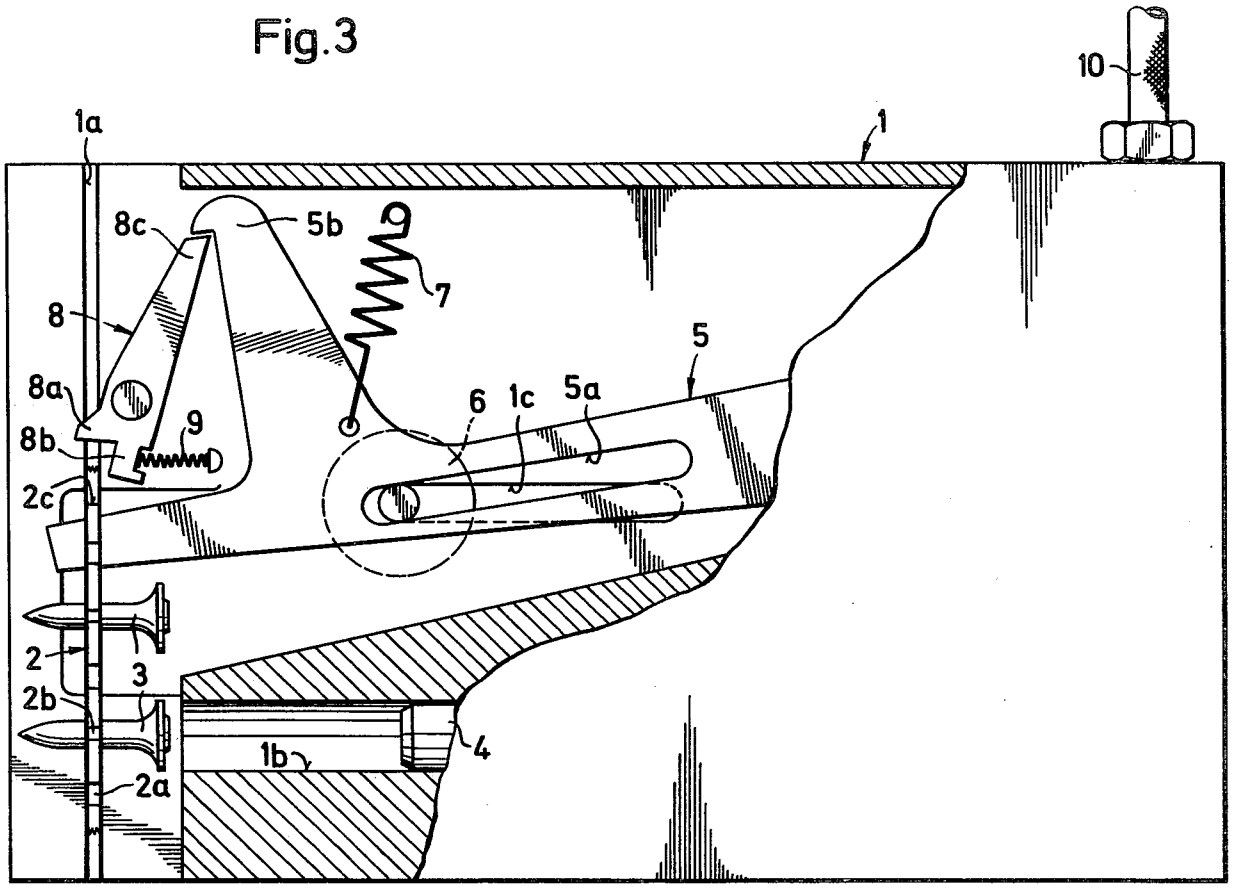
FIG. 3 is a view similar to FIG. 1, however, the transport lever is locked in position.

In FIG. 2 a section is shown through the guide channel 1*a* in the housing 1. The magazine 2 is located in the guide channel 1*a*. Recesses 2*a* are equidistantly spaced along both edges of the belt-like magazine 2. Between each pair of adjacent recesses 2*a* is a notch 2*b* which effects a separation of a portion of the magazine 2 when a fastening element 3 is driven from the magazine. When a length of the magazine is separated for use it breaks off across a pair of the opposed notches 2*b*. As viewed in FIG. 2, the end of the transport lever 5 engages within a recess 2*a*. The transport handle 6 used for manual operation of the transport lever 5 is shown projecting laterally from the housing 1. Spaced above the engagement of the transport lever 5, in one of the recesses 2*a*, is the detent 8*a* of the two-armed lever 8 which projects into another recess 2*a* of the magazine 2. As mentioned previously the detent 8*a* acts as a stop of any rearward or return movement of the magazine 2. After effecting the downward movement of the magazine through one fastening element spacing, release of the transport handle 6 causes the transport lever to move upwardly under the action of the spring 7 until the end of lever engages the next upwardly located recess 2*a*. When a length of the magazine 2 is broken off, it is provided with an edge 2*c* at its rearward end. Without the safety effect of the present invention, during the last displacing action of the transport lever on the magazine, it would act on the edge 2*c* and, as a result, cause the movement of the magazine 2 through the guide channel 1*a* for only half of the distance between adjacent fastening elements. With such a half spacing movement, the drive piston would impact against the magazine between the last two fastening elements held by it.

In FIG. 3 the setting device is shown after the trailing edge 2*c* of the magazine has moved downwardly past the detent 8*a*. The transport lever 5 has been pivoted back into its starting position by the tension spring 7 and the transport handle has moved forwardly through the slots 1*c*, 5*a* in the direction towards the guide handle 1*a*. Since the detent 8*a* on the lever no longer rests in its first position in contact with the magazine, the action of the compression spring 9 biases it in the clockwise direction so that the detent further traverses the guide channel 1*a* into its second position. In this second position, as the first arm 8*b* of the two-armed lever moves toward the front end of the housing 1, the second arm 8*c* moves rearwardly into engagement with a pawl 5*b* extending upwardly from the lever 5. The interengagement of the upper end of the second arm 8*c* with the pawl 5*b* effects a locking action on the transport lever 5. As a result, since the transport lever cannot be moved, the magazine 2 cannot be displaced downwardly through the guide channel. The two-armed lever 8 can be pivoted counterclockwise for releasing the transport lever 5 only by inserting another length of the belt-like magazine into the guide channel downwardly from its upper end. With this arrangement, after the fastening element 3 positioned in the path of the piston guide 1*b* is driven in, the length of the magazine extending above the piston guide is always greater than its width. Accordingly, jamming of the magazine to within the guide channel 1*a* is prevented.

While the transport device shown in the drawing is operated manually, it is to be understood that this is merely shown by way of example. Alternatively, the transport device could be operated pneumatically, electromagnetically or in some other similar manner. Further, the stop arrangement for the transport device could also be used for a magazine holding cartridges. While the setting device shown in the drawings is operated with compressed air, other driving means could be used, such as explosive powder charges.

While specific embodiments of the invention have been shown and described in detail to illustrate the application of the inventive principles, it will be understood that the invention may be embodied otherwise without departing from such principles.

What is claimed is:

1. Setting device for driving fastening elements, comprising a housing, means in said housing for driving fastening elements in a first direction, a guide channel within said housing for guiding a belt-shaped magazine containing spaced fastening elements, said guide channel having an inlet end, an outlet end and extending transversely of the first direction, a transport device within said housing for moving the belt-like magazine in a step-wise manner through said guide channel for aligning fastening elements in the magazine in the path of said driving means, wherein the improvement comprises stop means movably displaceably mounted in said housing for displacement into said guide channel into a first position and a second position therein so that in the first position said transport device can be operated for moving the belt-like magazine and in the second position said stop means blocks the operation of said transport device for moving the belt-like magazine, said stop means comprises an elongated lever having a first end and a second end, said lever pivotally mounted in said housing with the point of pivotal attachment located intermediate the first and second ends of said lever and dividing said lever into a first lever arm extending from the point of pivotal attachment to the first end thereof and a second lever arm extending from the point of pivotal attachment to the second end thereof, said first lever arm being displaceable into said guide channel into the first and second positions of said stop means, and said second lever arm arranged to block said transport device when said first lever arm is in the second position.

2. Setting device, as set forth in claim 1, wherein said stop means include a spring for biasing said first lever arm into said guide channel.

3. Setting device, as set forth in claim 1, wherein said first lever arm includes a detent extending therefrom, said detent located between the inlet end of said guide channel and said driving means, said detent being arranged to engage in recesses in the magazine passing through said guide channel when said stop means is in the first position and to extend across said guide channel when said stop means is in the second position.

4. Setting device, as set forth in claim 3, wherein said detent has a saw-toothed edge.

5. Setting device, as set forth in claim 4, wherein said saw-toothed shaped detent has a first edge facing toward the inlet end of said guide channel and a second edge facing toward said outlet end of said guide channel in the first position of said stop means, said first edge extends obliquely of said guide channel and said second end extends approximately perpendicularly of said guide channel.

6. Setting device, as set forth in claim 1, wherein said transport device has a pawl thereon located adjacent the second end of said lever, and in the second position of said stop means the second end of said lever is displaced into blocking contact with said pawl.

7. Setting device, as set forth in claim 6, wherein said housing has an oblong slot therein extending generally in the same direction as the first direction, said transport device comprises a handle extending through said slot from the exterior into the interior of said housing, a transport lever located within said housing and extending generally in the same direction as the first direction, said transport lever having a slot therein extending at an acute angle to the oblong slot in said housing, said handle extending through said slot in said transport lever and being displaceable in the first direction through both of said slots, said pawl extending transversely from said transport lever, said transport lever having a first end extending into said guide channel for engaging a recess in the belt-shaped magazine so that by moving said handle through said slots the first end of said transport lever moves the magazine in a step-like manner through said guide channel.

* * * * *